US005293173A

United States Patent [19]

Kropielnicki et al.

[11] Patent Number: 5,293,173

[45] Date of Patent: Mar. 8, 1994

[54] SIGNAL SEPARATING DEVICE

[75] Inventors: Jerzy J. Kropielnicki, Knutsford; Brian Easter, Llangefni, both of United Kingdom

[73] Assignee: Glass Antennas Technology Limited, Stockport, United Kingdom

[21] Appl. No.: 820,612

[22] PCT Filed: Jul. 10, 1990

[86] PCT No.: PCT/GB90/01059

§ 371 Date: Jan. 28, 1992

§ 102(e) Date: Jan. 28, 1992

[87] PCT Pub. No.: WO91/01575

PCT Pub. Date: Feb. 7, 1991

[30] Foreign Application Priority Data

Jul. 19, 1989 [GB] United Kingdom ..... 8916524

[51] Int. Cl.[5] ..... H01Q 1/020; H01Q 1/320

[52] U.S. Cl. ..... 343/704; 343/713

[58] Field of Search ..... 343/704, 713, 712, 861; 455/280, 286, 291; H01Q 1/32, 1/02, 1/44

[56] References Cited

U.S. PATENT DOCUMENTS 4,654,669 3/1987 Kropielnicki et al. ..... 343/704

FOREIGN PATENT DOCUMENTS 0146339 6/1985 European Pat. Off. ..... 343/704
0269924 6/1988 European Pat. Off. ..... 343/704
3243052 5/1984 Fed. Rep. of Germany ..... 343/713

*Primary Examiner*—Rolf Hille
*Assistant Examiner*—Peter Toby Brown
*Attorney, Agent, or Firm*—Shoemaker and Mattare, Ltd.

[57] ABSTRACT

A device for use with an electrically heated window to enable it to be used as a radio antenna has a bifilar wound choke (2) which allows passage of heater current while isolating radio signals from the heater power circuit. The device is connected to radio apparatus via an amplifier (13). The choke (2) and the input of the amplifier (13) are both of relatively low impedance. The choke (2) may be a pot-cored bifilar winding and the amplifier (13) may use a field effect transistor in its input stage connected in grounded gate configuration.

15 Claims, 2 Drawing Sheets

To Heater Element
3
4
9
10
To VHF Buffer Amplifier
1
11
8
2
Heater Supply
5
7
6
Prior Art Prior Art
Input Capacity of v.h.f circuit Ca
Va
L
Rp
+
x 1
−

SIGNAL SEPARATING DEVICE

TECHNICAL FIELD

This invention relates to a signal separating device for separating a radio signal from the heating element of an electrically heated motor vehicle window to enable such window to be used as a radio antenna.

BACKGROUND ART

Our earlier U.K. patent 1520030 describes a device of this kind which uses a bifilar choke connected between the heating element and the vehicle d.c. power supply. The choke presents low impedance paths to the relatively large current flow required to power the heating element, and high impedance paths to radio signals.

In practice, when used with a heated window typically consuming 17 A at 12 V for heating purposes, two bifilar chokes may be used, one of relatively small inductance, about 1 μH, which is effective in the vhf range (from 50 MHz to 400 MHz), and a second of much larger value, ideally greater than 10 mH, which is effective over the lowest frequency range of operation, typically down to 150 kHz. Around this lowest frequency, the impedance of the usual heater antenna with respect to the vehicle bodywork closely approaches that of its capacitance, in the region of 80 pF, with a reactance of about 12KΩ at 150 kHz. The use of the double-wound bifilar configuration is of key importance for this latter choke: since the d.c. magnetisation of the two windings will cancel, a closed magnetic core, such as a ferrite pot-core, may be used without saturation occurring. The required inductance can therefore be achieved with a relatively small number of turns of the thick conductor required to carry the d.c. operating current (say 1.6 mm diameter for 17 A) with a pot-core of acceptable bulk.

With this arrangement, the impedance of the choke is high compared with that of the antenna at the signal frequency whereby a strong radio signal having good signal to noise ratio can be separated.

However, even with the advantage of the double-wound bifilar configuration the low frequency range choke remains a relatively large and expensive component. In practice therefore a compromise value of inductance, say about 1 mH, is employed, for example with 9½ double turns on a 30 mm diameter core, and this results in some loss of performance at the lowest frequencies. Also, there can be cases where the size or cost of even such a compromise choke may be disadvantageous.

An object of the present invention is to provide an effective signal separating device with which it is possible to achieve good performance at low frequencies with a choke configuration of relatively small size.

DISCLOSURE OF THE INVENTION

According to the invention therefore there is provided a signal separating device for separating a radio signal from the heating element of an electrically heated motor vehicle window to enable such window to be used as a radio antenna, said device comprising first terminals for connection to the heating element, second terminals for connection to a power supply for the heating element, a radio signal terminal connected to at least one of the first terminals, and a LF choke arranged between the first and second terminals for blocking passage of radio signals at the radio signal terminal to the power supply whilst permitting flow of current from the power supply to the heating element, said LF choke comprising two mutually inductively coupled coils wound in a common direction, characterized in that there is provided a radio signal amplifier connected to the radio signal terminal connection, the choke being of relatively low impedance and the LF amplifier being of low input impedance. The input impedance of the amplifier may be similar or lower than that of the choke.

With this arrangement due to the use of the low input impedance amplifier it is possible to achieve optimum coupling with the antenna circuit comprising the window heating element and the relatively low impedance choke whereby, surprisingly, despite this low impedance, excellent performance can be obtained, even at low frequencies, with relatively small dimensions for the choke. This gives rise to two possibilities. First, there is the possibility of achieving much improved performance with existing relatively low impedance chokes. For example, using the above mentioned 1 mH choke, performance at or close to 'ideal' conditions, rather than 'compromise' performance, can be achieved. Second, there is the possibility of achieving acceptable 'compromise' performance with a much smaller impedance (and consequently much smaller size) choke. For example, a choke impedance of 400 μH or less (or 300 μH or less) can be used and an impedance of 200 μH or even less is feasible.

The use of the low input impedance amplifier is a significant departure from conventional practice and gives surprisingly dramatic advantages. Hitherto, high input impedance amplifiers have been used in correspondence with the high impedance of the usual window heater antenna. The present invention is based on the realisation that it is advantageous to seek to optimise the amplifier input impedance to the relatively low impedance attainable for the antenna circuitry comprising in combination the window heater and the choke where the choke is of relatively low impedance.

It is visualised that the device of the invention will be used in conjunction with a motor car heated rear window for receiving long wave and medium wave signals, preferably but not necessarily AM broadcast signals. However, the invention is not intended to be restricted to this field of application and the device may be used for any suitable purpose in any suitable context. In particular, the device need not be used with a rear window, and it may be used with vehicles other than motor cars.

With regard to the choke, this may comprise a bifilar winding or other double winding and a ferrite pot-core or any other suitable magnetic core may be used.

With regard to the amplifier, this may be of any suitable low input impedance kind. It may be of high gain and, for example, it may comprise an FET (field effect transistor) amplifier stage connected in grounded gate configuration. It is however not essential to use an FET amplifier of this kind or indeed to have high gain. Any suitable amplifier may be used and the gain may be of any suitable value including possibly unity. The essential feature is that the amplifier should be of the low input impedance kind. A low input impedance amplifier is 'current driven', i.e. it has an input impedance which may be of the order of tens or hundreds of ohms whereby an appreciable current is drawn from the circuitry connected to the input sufficient to be capable of changing the operating conditions of such circuitry. Typically, in the context of a transistor amplifier stage, the transistor circuit may be of the common-base or grounded-base or grounded gate kind. A high input impedance amplifier is 'voltage driven', i.e. it has an input impedance which may be of the order of Megohms whereby an insignificant current is drawn from the circuitry connected to the input and it is the voltage (e.g. at the base of a common-emitter or grounded-emitter transistor amplifier stage) which is important.

BRIEF DESCRIPTION OF THE DRAWINGS

The invention will now be described further by way of example only and with reference to the accompanying drawings in which.

DESCRIPTION OF THE PREFERRED EMBODIMENT

Figure 1:
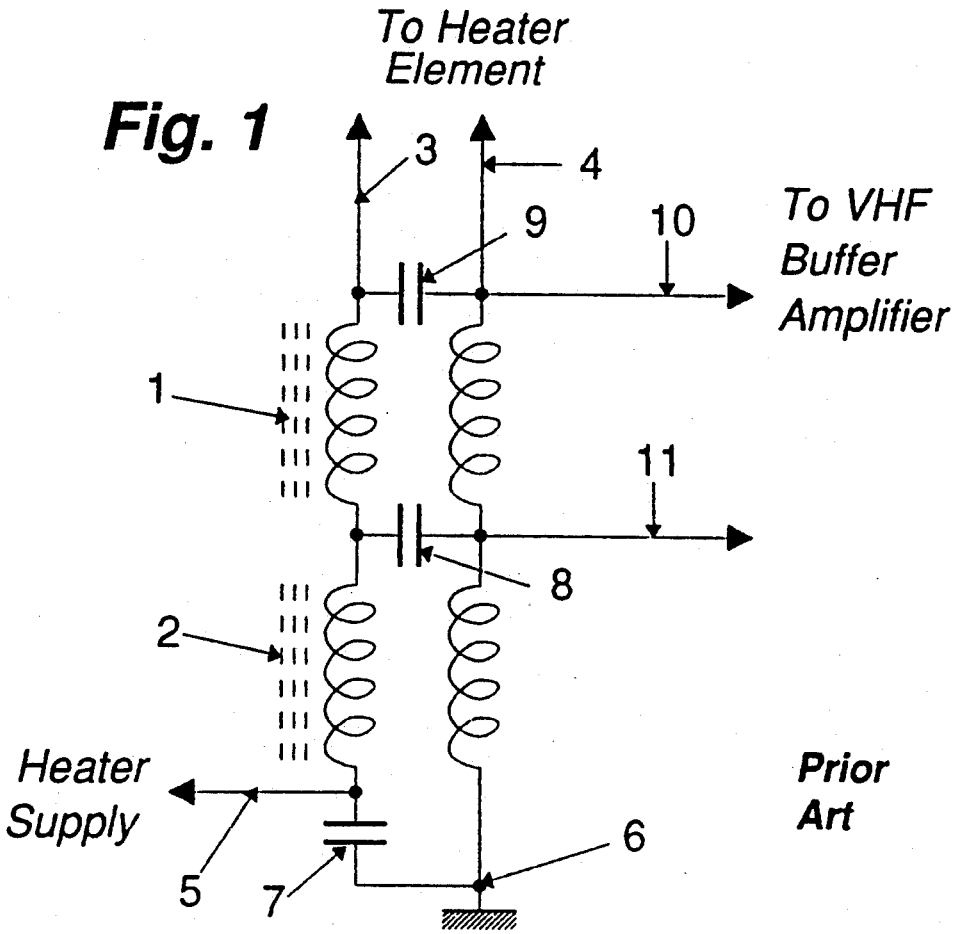
FIG. 1 is a diagram of a choke arrangement forming part of a prior art signal separating device.

With reference to FIG. 1, a known signal separating device for use with a motor vehicle heated window such as a motor car rear window comprises two bifilar chokes 1, 2 connected between first terminals 3, 4 which are connected to the heating element of the window and second terminals 5, 6 which are connected respectively to d.c. power supply positive and earth. Capacitors 7, 8, 9 are connected between the ends of the windings of the chokes 1, 2.

One VHF choke 1 is of relatively small inductance, about 1 μH effective in the usual vhf broadcast range. The other VHF choke 2 is of higher inductance effective in the long and medium wave range (low frequencies from say 1.8 MHz down to say 150 kHz).

Signal output terminals 10, 11 are connected to the respective chokes 1, 2 and are connected respectively via a vhf buffer amplifier and a long wave/medium wave buffer amplifier (unity-gain follower) to the antenna input circuit of a radio receiver.

Figure 2:
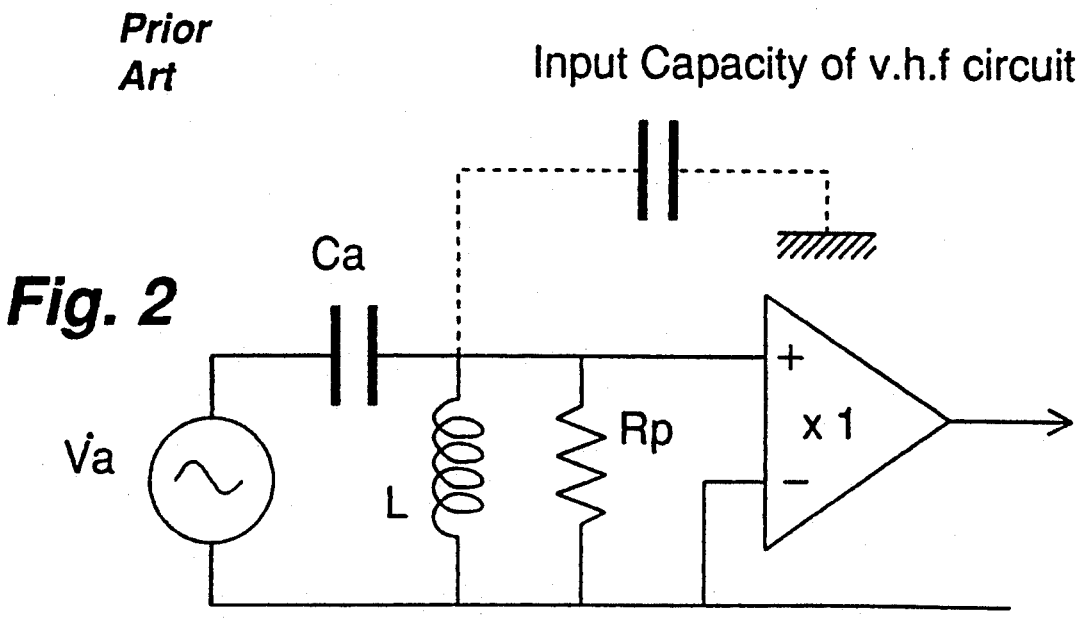
FIG. 2 is an equivalent circuit for the arrangement of FIG. 1.

FIG. 2 shows an equivalent circuit for the long wave/medium wave arrangement described above.

The antenna is modelled by a voltage source and series capacitance $C_a$, and there will be additional capacitance due to the input impedance of the vhf circuit. L is the inductance of the low frequency choke 2 and $R_p$ its effective parallel loss resistance. The resonant frequency of the inductance and the total capacitance is likely to be in the region of 400 kHz, and there will be a considerable fall in response towards the low frequency limit of the long wave band at 150 kHz, due to the expected 12 dB/octave roll-off of this configuration. In addition there may be accentuated variation of response in the region of the resonant frequency, depending on the value of $R_p$. It is possible to control this, for example by adding an additional resistor in parallel, but this will result in an undesirable deterioration of signal/noise performance, which could well be significant, depending on the ambient radio-noise level at the antenna.

Figure 3:
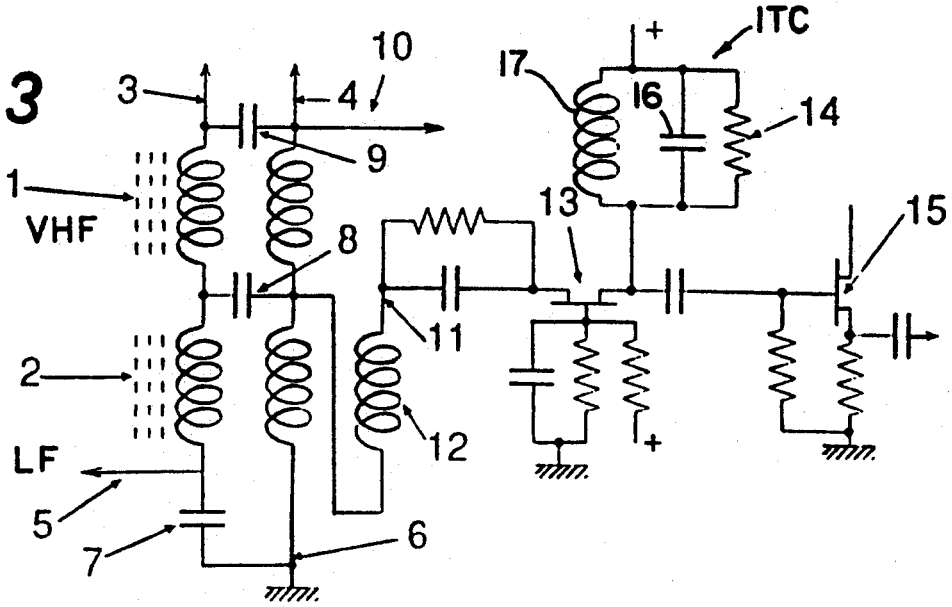
FIG. 3 is a circuit diagram of a signal separating circuit according to the invention.

FIG. 3 shows a similar arrangement of VHF and low frequency (LF) isolating chokes 1, 2 as in FIG. 1 (and the same reference numerals are used for corresponding parts). Here the low frequency signal is shown to be derived via a coupling coil 12 wound on the low frequency inductor 2 acting as an auto-transformer, but alternatively the connection at the junction of the two chokes 1, 2 may be used, as in FIG. 1 via radio frequency terminal. The signal is fed to the input of a first FET amplifier stage 13, connected in grounded-gate configuration, which may be coupled via a low-Q resonant circuit 14 in the drain circuit to an FET source follower 15 output stage. The output of the latter may be combined with the output of the vhf buffer amplifier (connected to terminal 10) to provide a common output.

The requirements of the low frequency choke 2 are now somewhat relaxed: the impedance of this component is now only required to be large relative to the low input impedance of the amplifier 13. However, it is still desirable for the effective parallel-loss resistance to be high enough to avoid a signal-to-noise penalty. It is now possible to gain improved performance with a 1 mH choke inductance down to 150 kHz, or, alternatively, to achieve acceptable performance with a reduced choke inductance of, say, 200 μH or less. The use of a coupling coil at the input of the grounded-gate stage allows an additional degree of freedom in the optimisation of the signal/noise and gain characteristics. The level of gain and its variation can also be controlled by appropriate choice of the parameters of the interstage coupling. This will depend on the inductance value chosen for the double wound LF choke 2, and the extent to which it is desired to maintain high performance down to the lowest frequency of operation. Typically, the interstage coupling circuit ITC will be resonant towards the lower frequencies of operation say 200 kHz, will have a Q function of approximately unity, and an impedance level giving an overall voltage gain of unity, leading to values such as 22 mH, 80 pF, 10K Ω for inductor 17, capacitor 16, and resistor 14, respectively, of the ITC.

Figure 4:
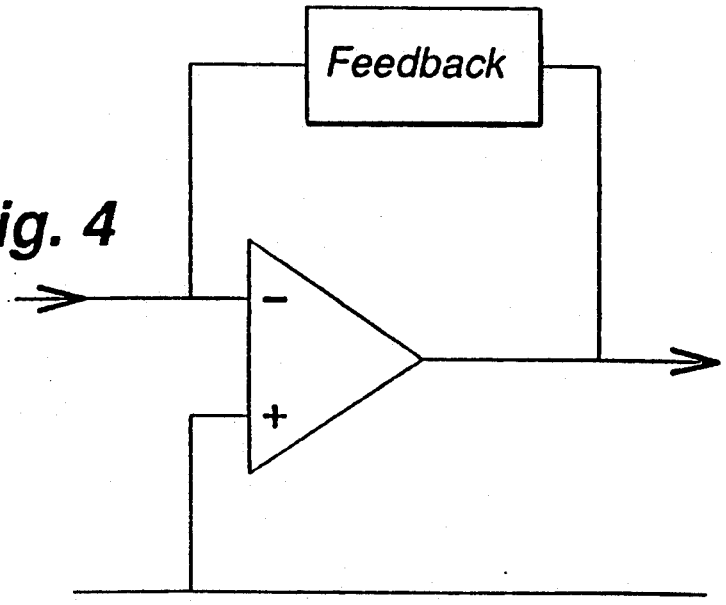
FIG. 4 shows a modification to the circuit of FIG. 3.

Alternative configurations of low input impedance amplifier are possible, such as, for example, those indicated by the generic configuration of FIG. 4, which depend on the use of shunt-connected negative feedback to achieve low input impedance, low output impedance amplifier action.

As mentioned, the third coil 12 is not essential. With the third coil the input impedance of the amplifier does not have to be quite so low. It is however feasible to omit the coil and use a suitably lower input impedance amplifier.

We claim:

1. A signal separating device for use at long wave/medium wave frequencies and for separating a radio signal from the heating element of an electrically heated motor vehicle window to enable such heating element to be used as a radio antenna, said device comprising first terminals (3, 4) for connection to said heating element, second terminals (5, 6) for connection with a power supply for the said heating element, a radio signal terminal connection (11) connected via a VHF choke (1) to at least one of said first terminals (3, 4) and an LF choke (2) arranged between the said first and second terminals for blocking passage of radio signals to the power supply whilst permitting flow of current from the power supply to the heating element, said LF choke (2) comprising two mutually inductively coupled coils wound in a common direction, characterized in that there is provided a radio signal LF amplifier (13) connected to said radio signal terminal (11) and comprising an FET amplifier stage connected in grounded gate configuration, said LF amplifier (13) having an input impedance which is low relative to the impedance of said radio antenna and to the impedance of the said LF choke (2).

2. A signal separating device according to claim 1 characterised in that said LF choke comprises a bifilar winding.

3. A signal separating device according to claim 1 characterised in that said LF choke has a magnetic core.

4. A signal separating device according to claim 1 for use at long wave/medium wave frequencies down to approximately 150 kHz characterized in the inductance of the LF choke (2) is of the order of 1 mH.

5. A signal separating device according to claim 1 for use at long wave/medium wave frequencies down to approximately 150 kHz characterized in that the inductance of the LF choke (2) is substantially less than 1 mH.

6. A signal separating device according to claim 5 characterized in that the inductance of the LF choke (2) inductance is less than 400 μH.

7. A signal separating device according to claim 6 characterized in that the inductance of the LF choke (2) inductance is of the order of 200 μH.

8. A signal separating device according to claim 2 for use at long wave/medium wave frequencies down to approximately 150 kHz characterized in that the inductance of said LF choke (2) is of the order of 1 mH.

9. A signal separating device according to claim 3 for use at long wave/medium wave frequencies down to approximately 150 kHz characterized in that the inductance of said LF choke (2) is of the order of 1 mH.

10. A signal separating device according to claim 2 for use at long wave/medium wave frequencies down to approximately 150 kHz characterized in that the inductance of said LF choke (2) is substantially less than 1 mH.

11. A signal separating device according to claim 10 characterized in that the inductance of said LF choke (2) is less than 400 μH.

12. A signal separating device according to claim 11 characterized in that the inductance of said LF choke (2) is of the order of 200 μH.

13. A signal separating device according to claim 3 for use at long wave/medium wave frequencies down to approximately 150 kHz characterized in that the inductance of said LF choke (2) is substantially less than 1 mH.

14. A signal separating device according to claim 13 characterized in that the inductance of said LF choke (2) is less than 400 μH.

15. A signal separating device according to claim 14 characterized in that the inductance of said LF choke (2) is of the order of 200 μH.

* * * * *